US012383059B2

(12) United States Patent
Chen et al.

(10) Patent No.: US 12,383,059 B2
(45) Date of Patent: Aug. 12, 2025

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 133 days.

(21) Appl. No.: 18/375,991

(22) Filed: Oct. 2, 2023

(65) Prior Publication Data

US 2024/0360870 A1 Oct. 31, 2024

(30) Foreign Application Priority Data

Apr. 26, 2023 (TW) ..... 112115890

(51) Int. Cl.
*F16C 29/02* (2006.01)
*A47B 88/463* (2017.01)

(52) U.S. Cl.
CPC ..... *A47B 88/463* (2017.01)

(58) Field of Classification Search
CPC ..... A47B 88/463; A47B 2210/0008; A47B 2210/001; A47B 2210/0013
See application file for complete search history.

(56) References Cited

U.S. PATENT DOCUMENTS

| | | | | |
|---|---|---|---|---|
| 8,857,868 | B2 | 10/2014 | Liang | |
| 2004/0000851 | A1* | 1/2004 | Lam Harn | A47B 88/447 312/334.7 |
| 2011/0129172 | A1* | 6/2011 | Liang | A47B 88/463 384/22 |

FOREIGN PATENT DOCUMENTS

| | | | |
|---|---|---|---|
| CN | 102755015 | A | 10/2012 |
| EP | 2272400 | B1 | 2/2019 |
| JP | 2008296616 | A * | 12/2008 |

* cited by examiner

*Primary Examiner* — Matthew W Ing
(74) *Attorney, Agent, or Firm* — Winston Hsu

(57) ABSTRACT

A slide rail assembly includes a first rail, a second rail, a controlling member, an aiding member, a working member and a resilient structure. When the second rail is pulled from a retracted position relative to the first rail, the controlling member and the working member abut against each other to generate an acting force for driving the working member to rotate from a first state to a second state, such that a controlling portion of the controlling member is moved from a locking position relative to a predetermined path structure of the aiding member for allowing the second rail to be opened. The working member returns to the first state from the second state in response to a returning resilient force provided by the resilient structure.

14 Claims, 10 Drawing Sheets

SLIDE RAIL ASSEMBLY

BACKGROUND OF THE INVENTION

1. Field of the Invention

The present invention relates to a slide rail product, and more specifically, to a slide rail assembly having a push-open mechanism with a protective function.

2. Description of the Prior Art

With advancement of the industrial technology, there are various slide rail products with various functions in the market. For example, some of the slide rail products are slide rail assemblies with push-open mechanisms. When a drawer is mounted on a cabinet by a slide rail assembly with a push-open mechanism and is located at a retracted position relative to the cabinet, there is gap formed between a front panel portion of the drawer and the cabinet for allowing the push-open mechanism to drive the drawer to be opened relative to the cabinet by pushing the drawer relative to the cabinet.

If the drawer is accidentally pulled from the retracted position due to the user's habit or the user's unawareness of the push-open mechanism, a movement of a movable rail of the slide rail assembly attached on the drawer may cause a structural damage and/or a functional failure of the push-open mechanism. Therefore, the push-open mechanism requires a protective function.

For example, in U.S. Pat. No. 8,857,868 B2, it discloses a closing device including an engaging mechanism. The engaging mechanism includes an engaging block, a positioning hook and a pin. The engaging block has an abutting surface and a guiding surface extending from the abutting surface. The positioning hook is connected to the engaging block and has a resilient portion and a stop which extends from the resilient portion. The stop is located adjacent to the abutting surface and away from the guiding surface. The pin is located at a position corresponding to the engaging block and slidably abuts against the abutting surface and the stop of the positioning hook. When a movable rail or a drawer is pulled to be opened, the pin abuts against the stop and the abutting surface, such that the resilient portion is resiliently deformed for allowing the pin to move over the stop to disengage from the abutting surface, which prevents abrasion or damage of the engaging hook, so as to achieve a purpose of protection.

Furthermore, in EP 2272400 B1, it discloses a locking device adapted for a drawer slide. As shown in FIG. 5A of EP 2272400B1, the locking device includes a disc having a protruding portion configured to receive or lock an end of a switching element when the disc is located at an initial position. As shown in FIG. 5B of EP 2272400B1, when a movable rail or a drawer is pulled to be opened, the end of the switching element disengages from the protruding portion of the disc by a rotating movement of the disc, which achieves a purpose of protection. Besides, the disc can return to the initial position by a spring after the movable rail or the drawer is retracted.

However, in order to meet various requirements, it becomes an important topic to provide an improved slide rail assembly.

SUMMARY OF THE INVENTION

It is an objective of the present invention to provide a slide rail assembly having a push-open mechanism with a protective function.

According to an aspect of the present invention, a slide rail assembly includes a first rail, a second rail, a driving device, a controlling member, an aiding member, a working member and a resilient structure. The second rail is displaceable relative to the first rail along a first direction or a second direction opposite to the first direction. The driving device includes a resilient member configured to provide a resilient force along the second direction. The controlling member is movably mounted on one of the first rail and the second rail. The controlling member includes a controlling portion. The aiding member is arranged on another one of the first rail and the second rail. The aiding member includes a predetermined path structure. The working member is movable relative to the aiding member. The working member includes a working portion located adjacent to the predetermined path structure. The resilient structure is configured to provide a returning resilient force to the working member for resiliently retaining the working member in a first state. When the second rail is located at a retracted position relative to the first rail, the controlling member and the working portion of the working member in the first state block each other, so as to position the controlling portion of the controlling member at a locking position for maintaining the resilient force provided by the resilient member. When the second rail is pushed by a first force from the retracted position relative to the first rail along the first direction, the aiding member guides the controlling portion of the controlling member to move from the locking position relative to the predetermined path structure, so as to allow the resilient member to drive the second rail to be opened along the second direction by the resilient force. When the second rail is pulled by a second force from the retracted position relative to the first rail along the second direction, the controlling member and the working portion of the working member in the first state abut against each other to generate an acting force for driving the working member to rotate from the first state to a second state, such that the controlling portion of the controlling member is moved from the locking position relative to the predetermined path structure for allowing the second rail to be opened along the second direction. The working member returns to the first state from the second state in response to the returning resilient force provided by the resilient structure.

According to another aspect of the present invention, a slide rail assembly includes a first rail, a second rail, a driving device, a controlling member, an aiding member, a working member and a resilient structure. The second rail is displaceable relative to the first rail along a first direction or a second direction opposite to the first direction. The driving device includes a resilient member configured to provide a resilient force along the second direction. The controlling member is movably mounted on one of the first rail and the second rail. The controlling member includes a controlling portion. The aiding member is arranged on another one of the first rail and the second rail. The aiding member includes a predetermined path structure. The predetermined path structure includes an entry section and a releasing section communicated with the entry section. The working member is movable relative to the aiding member. The working member includes a working portion located between the entry section and the releasing section. The working portion of the working member includes an abutting section. An offset angle is formed between an extending line passing through the abutting section and a center of the working member and an extending line passing through the center of the working member along the first direction or the second direction. The resilient structure is configured to provide a returning resilient force to the working member for resiliently retaining the working member in a first state. When the second rail is located at a retracted position relative to the first rail, the controlling member and the working portion of the working member in the first state block each other, so as to position the controlling portion of the controlling member at a locking position for maintaining the resilient force provided by the resilient member by a blocking of the controlling portion of the controlling member and the abutting section. When the second rail is pulled from the retracted position relative to the first rail along the second direction, the controlling member and the working portion of the working member in the first state abut against each other to generate an acting force for driving the working member to rotate from the first state to a second state, such that the controlling portion of the controlling member is moved from the locking position relative to the predetermined path structure for allowing the second rail to be opened along the second direction.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The members of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
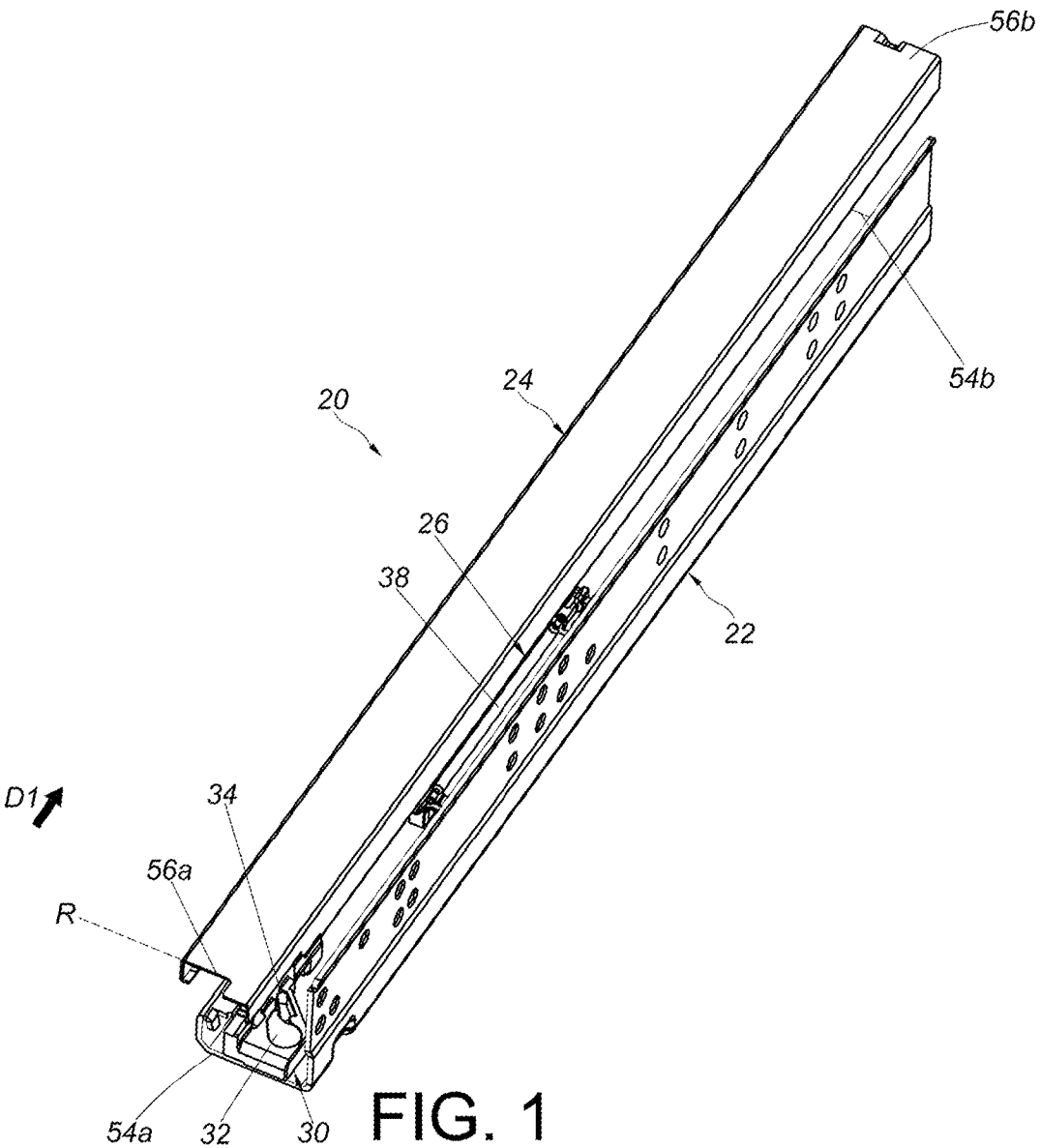
FIG. 1 is a schematic diagram of a slide rail assembly according to an embodiment of the present invention.
Figure 2:
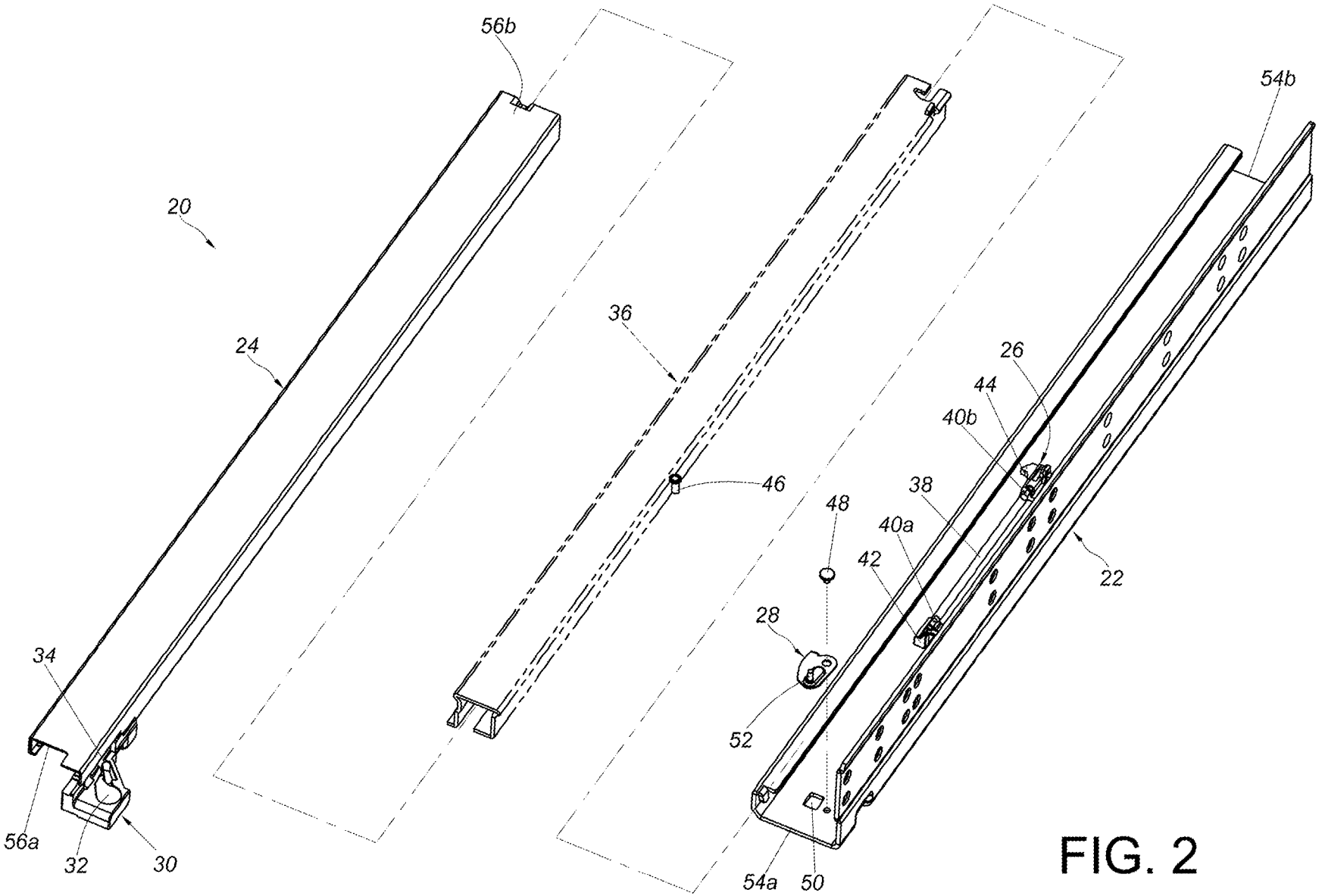
FIG. 2 is an exploded diagram of the slide rail assembly according to the embodiment of the present invention.

As shown in FIG. 1 and FIG. 2, a slide rail assembly 20 includes a first rail 22, a second rail 24, a driving device 26, a controlling member 28, an aiding member 30, a working member 32 and a resilient structure 34.

The second rail 24 is displaceable relative to the first rail 22 longitudinally. Preferably, the slide rail assembly 20 can further include a third rail 36 movably mounted between the first rail 22 and the second rail 24 and for extending a displacement of the second rail 24 relative to the first rail 22. In practical, the first rail 22 can be mounted or fixed on a cabinet, and the second rail 24 can be configured to support a drawer. Understandably, in another embodiment, the third rail can be omitted.

As shown in FIG. 1, the driving device 26 is configured to drive the second rail 24 to be opened after the second rail 24 is pushed from a retracted position R relative to the first rail 22 along a first direction D1, e.g., a retracting direction. The driving device 26 includes a resilient member 38. In this embodiment, by way of example, the resilient member 38 can be a spring. However, the present invention is not limited to this embodiment. The resilient member 38 includes a first end 40*a* and a second end 40*b* opposite to the first end 40*a*. The first end 40*a* of the resilient member 38 is fixed on the first rail 22 by a connecting member 42. A driving member 44 is arranged on the second end 40*b* of the resilient member 38. Preferably, a corresponding member 46 or a corresponding portion is arranged on the second rail 24 or the third rail 36 and located at a position corresponding to the driving member 44, so as to cooperate with the driving member 44. In this embodiment, by way of example, the corresponding member 46 can be arranged on the third rail 36. However, the present invention is not limited to this embodiment. For example, in another embodiment, the corresponding member or the corresponding portion can be arranged on the second rail.

Figure 6:
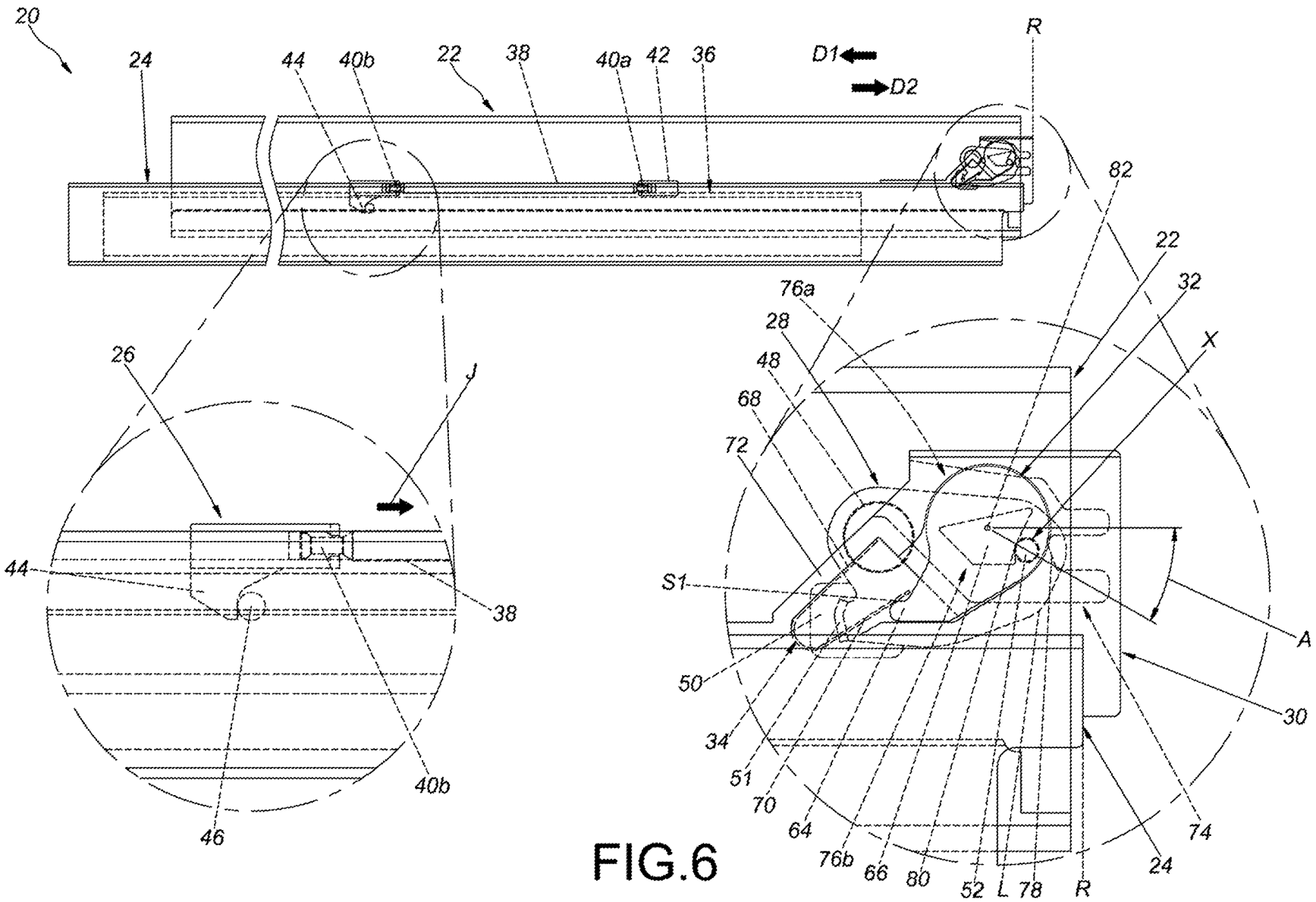
FIG. 6 is a diagram of the slide rail assembly as a second rail is located at a retracted position relative to a first rail according to the embodiment of the present invention.

The controlling member 28 is movably mounted on one of the first rail 22 and the second rail 24. In this embodiment, by way of example, the controlling member 28 can be movably mounted on the first rail 22. Specifically, the controlling member 28 can be pivotally connected to the first rail 22 by a shaft 48, such that the controlling member 28 is pivotable relative to the first rail 22. Preferably, as shown in FIG. 6, the first rail 22 includes a first restraining feature 50, and the controlling member 28 includes a second restraining feature 51, wherein one of the first restraining feature 50 and the second restraining feature 51 is an opening or a recess portion, and the other one of the first restraining feature 50 and the second restraining feature 51 is an extending leg stretching into the opening or the recess portion and configured to abut against a wall of the opening or the recess portion, such that the controlling member 28 is only allowed to pivot relative to the first rail 22 within a limited range. In this embodiment, by way of example, the first restraining feature 50 can be the opening, and the second restraining feature 51 can be the extending leg. However, the present invention is not limited to this embodiment.

The controlling member 28 includes a controlling portion 52. In this embodiment, by way of example, the controlling portion 52 can be a protruding portion or a pin. However, the present invention is not limited to this embodiment.

Preferably, the first rail 22 includes a front end portion 54*a* and a rear end portion 54*b*, and the controlling member 28 is located adjacent to the front end portion 54*a* of the first rail 22.

Figure 3:
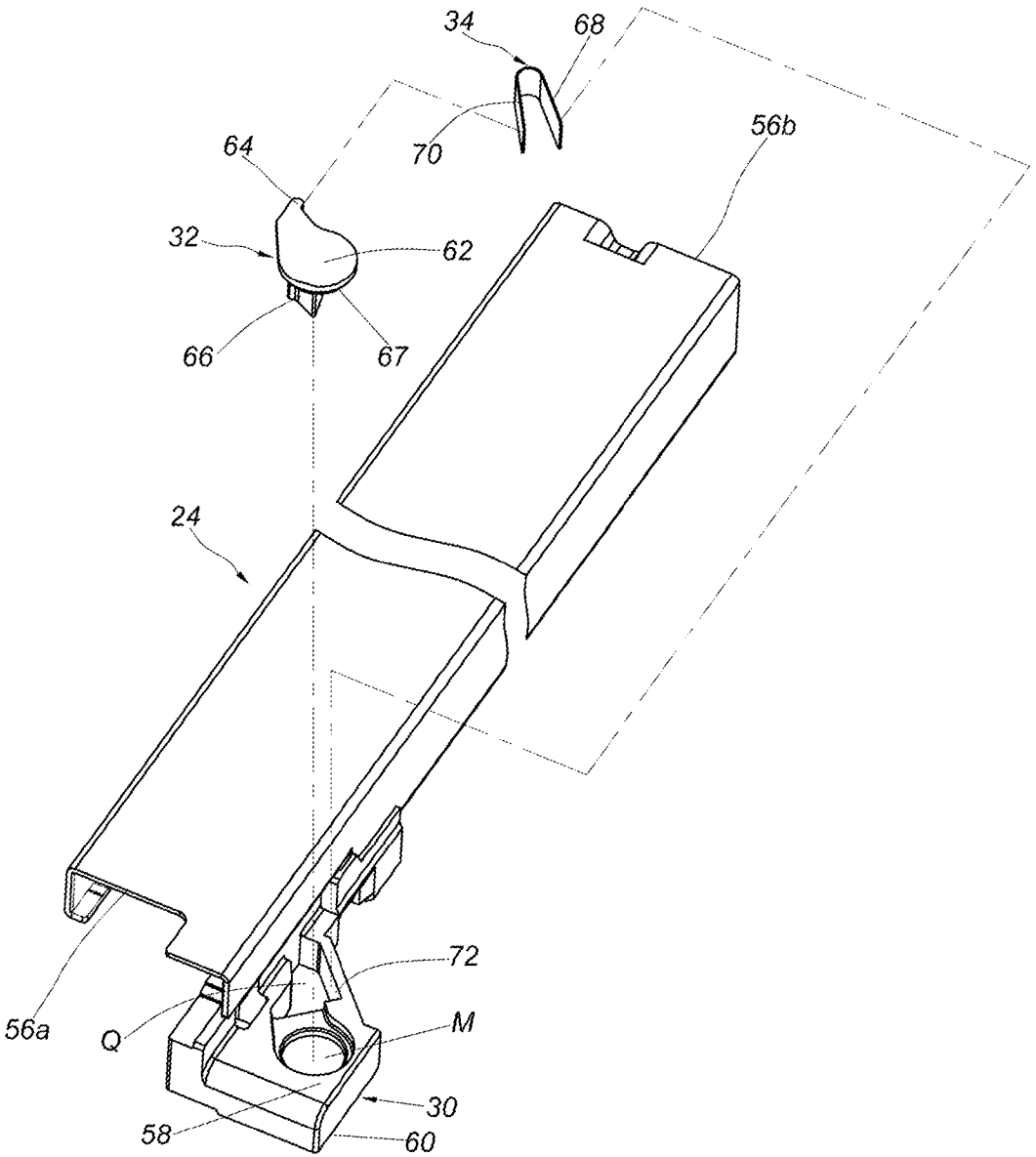
FIG. 3 is a partial exploded diagram of the slide rail assembly according to the embodiment of the present invention.
Figure 4:
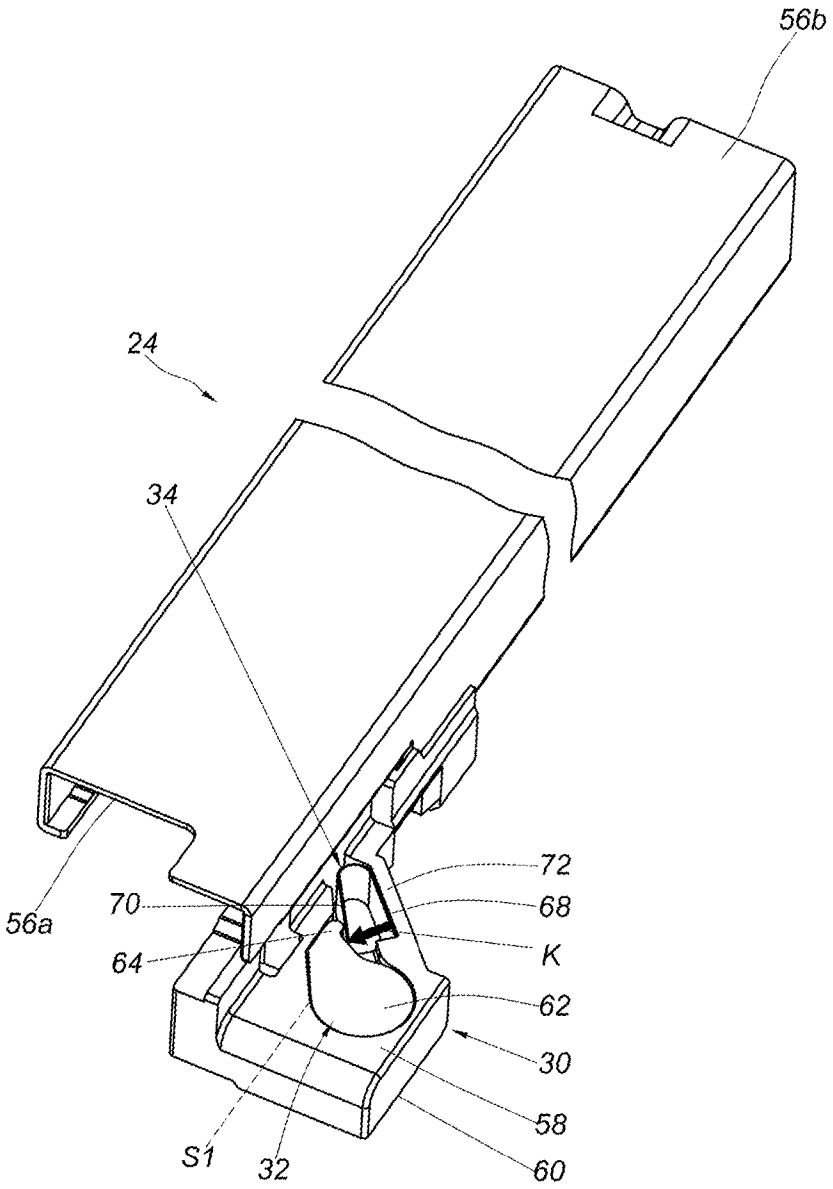
FIG. 4 and FIG. 5 are partial diagrams of the slide rail assembly at different views according to the embodiment of the present invention.
Figure 5:
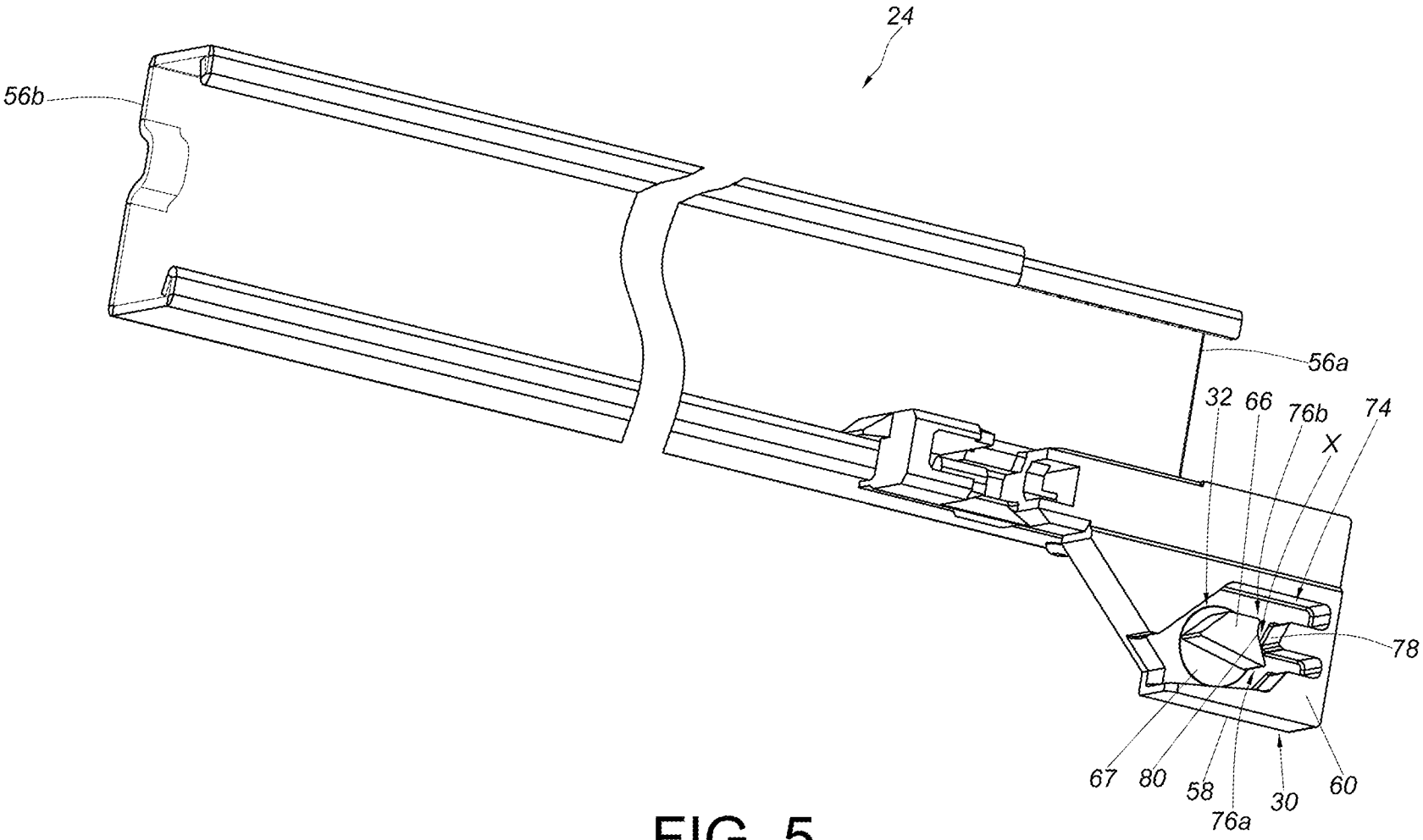

As shown in FIG. 3, FIG. 4 and FIG. 5, the aiding member 30 is arranged on the other one of the first rail 22 and the second rail 24 where the controlling member 28 is not disposed. In this embodiment, by way of example, the aiding member 30 can be arranged on the second rail 24. Preferably, the aiding member 30 can be connected to the second rail 24 directly or indirectly. The second rail 24 includes a front end portion 56*a* and a rear end portion 56*b*, and the aiding member 30 is arranged on the second rail 24 and located adjacent to the front end portion 56*a* of the second rail 24.

The working member 32 is movable relative to the aiding member 30. In this embodiment, by way of example, the working member 32 can be movably mounted on the aiding member 30.

The resilient structure 34 is configured to provide a returning resilient force K to the working member 32 for resiliently retaining the working member 32 in a first state S1 as shown in FIG. 4. In this embodiment, by way of example, the resilient structure 34 can be a leaf spring. However, the present invention is not limited to this embodiment. For example, in another embodiment, the resilient structure can be a spring or any other resiliently deformable object, e.g., a rubber cylinder.

Preferably, the aiding member 30 is configured to provide a moving space M for the working member 32. As shown in FIG. 3, the moving space M penetrates through a first portion 58 and a second portion 60 of the aiding member 30.

The working member 32 includes a working portion 66. Preferably, the working member 32 further includes a main body portion 62 and an extending section 64. The extending section 64 extends from the main body portion 62. The working portion 66 protrudes from a surface 67 of the main body portion 62. As shown in FIG. 4, the main body portion 62 and the extending section 64 are located adjacent to the first portion 58 of the aiding member 30. As shown in FIG. 5, the working portion 66 passes through the moving space M and is located adjacent to the second portion 60 of the aiding member 30.

Preferably, the aiding member 30 is further configured to provide an aiding receiving space Q for receiving the resilient structure 34. The aiding receiving space Q is located adjacent to the moving space M. The resilient structure 34 includes a first predetermined portion 68 and a second predetermined portion 70. As shown in FIG. 3 and FIG. 4, the first predetermined portion 68 is configured to abut against a wall 72 of the aiding member 30, and the second predetermined portion 70 is configured to abut against the extending section 64 of the working member 32.

As shown in FIG. 5, the aiding member 30 includes a predetermined path structure 74, and the working portion 66 of the working member 32 is located adjacent to the predetermined path structure 74.

Preferably, as shown in FIG. 5, the working portion 66 of the working member 32 is a heart-shaped protrusion and surrounded by the predetermined path structure 74. The predetermined path structure 74 includes an entry section 76*a* and a releasing section 76*b* communicated with the entry section 76*a*. The working portion 66 of the working member 32 is located between the entry section 76*a* and the releasing section 76*b*.

Preferably, the aiding member 30 further includes a guiding section 78. In this embodiment, by way of example, the guiding section 78 can be an inclined surface or an arc surface. The working portion 66 of the working member 32 further includes an abutting section 80.

Preferably, as shown in FIG. 3 or FIG. 5, the surface 67 of the main body portion 62 of the working member 32, is formed in a substantially circular shape.

As shown in FIG. 6, when the second rail 24 is located at the retracted position R relative to the first rail 22, the controlling member 28 and the working portion 66 of the working member 32 in the first state S1 can block each other, so as to position the controlling portion 52 of the controlling member 28 at a locking position L for maintaining a resilient force J provided by the resilient member 38 along a second direction D2, e.g., an opening direction, wherein the second direction D2 is opposite to the first direction D1.

Preferably, when the second rail 24 is located at the retracted position R relative to the first rail 22, the controlling portion 52 of the controlling member 28 and the abutting section 80 of the working portion 66 of the working member 32 in the first state S1 block each other, such that the controlling member 28 and the working portion 66 of the working member 32 in the first state S1 block each other, so as to position the controlling portion 52 of the controlling member 28 at the locking position L for maintaining the resilient force J provided by the resilient member 38 along the second direction D2 by a blocking of the controlling portion 52 of the controlling member 28 and the abutting section 80 of the working portion 66 of the working member 32. Furthermore, a locking space X is defined between the guiding section 78 and the abutting section 80 and configured to receive the controlling portion 52 of the controlling member 28.

Preferably, an offset angle A is formed between an extending line passing through the abutting section 80 and a center 82 of the working member 32, e.g., a center of the main body portion 62 of the working member 32, and an extending line passing through the center 82 of the working member 32 along the first direction D1 or the second direction D2.

Figure 7:
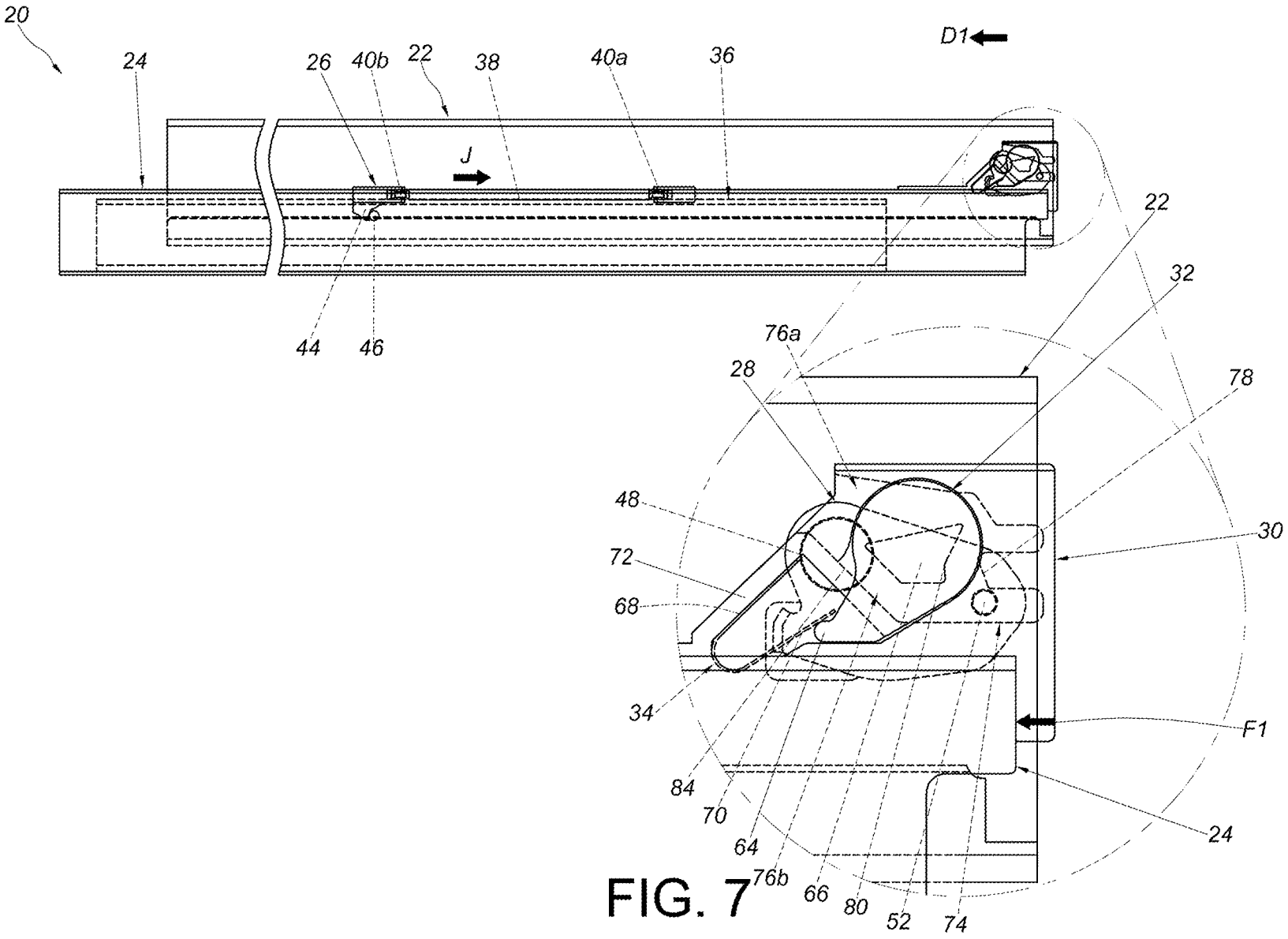
FIG. 7 is a diagram of the slide rail assembly as the second rail is pushed from the retracted position relative to the first rail along a first direction according to the embodiment of the present invention.
Figure 8:
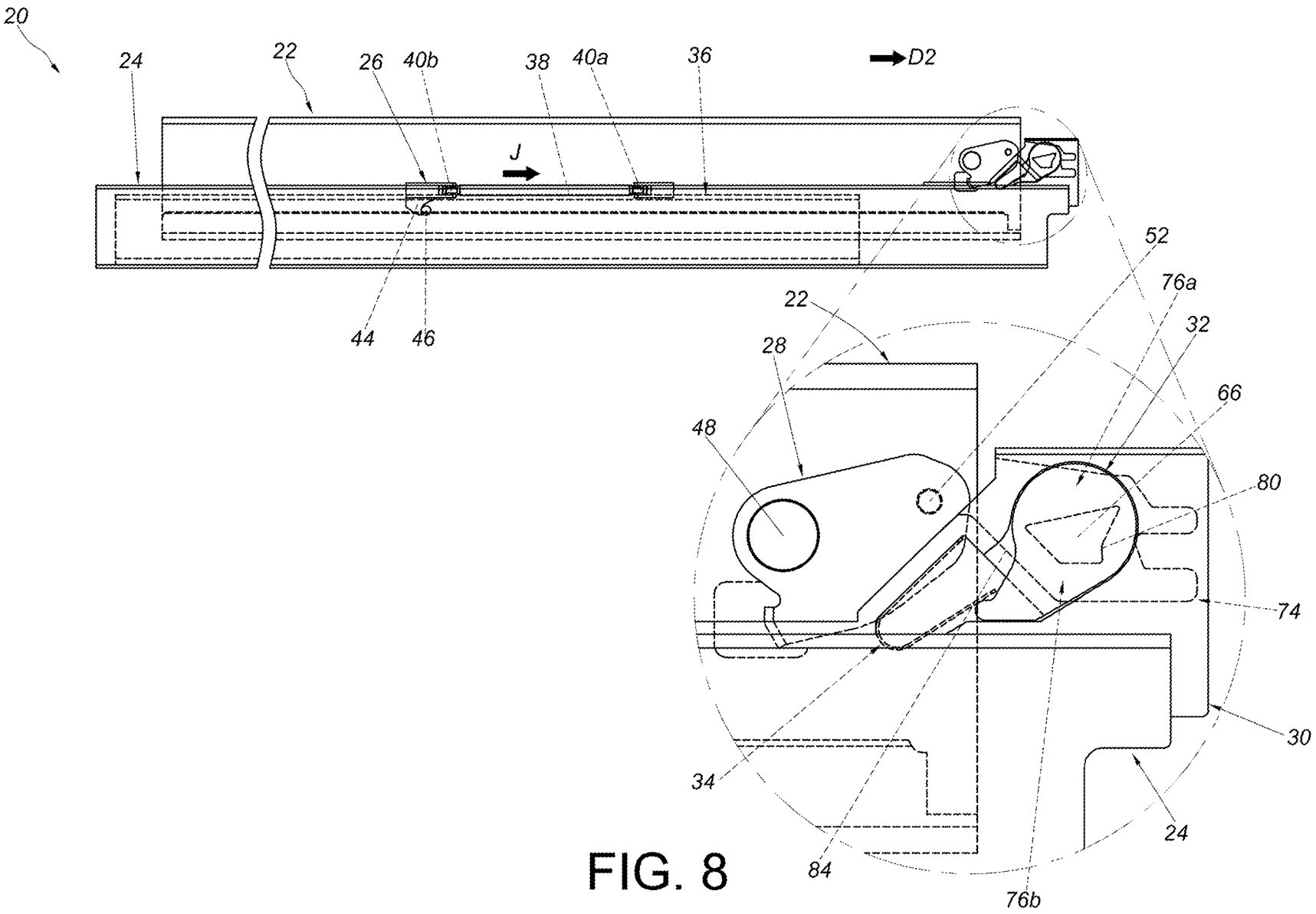
FIG. 8 is a diagram of the slide rail assembly as the second rail is driven to displace relative to the first rail along a second direction by a driving device according to the embodiment of the present invention.
Figure 9:
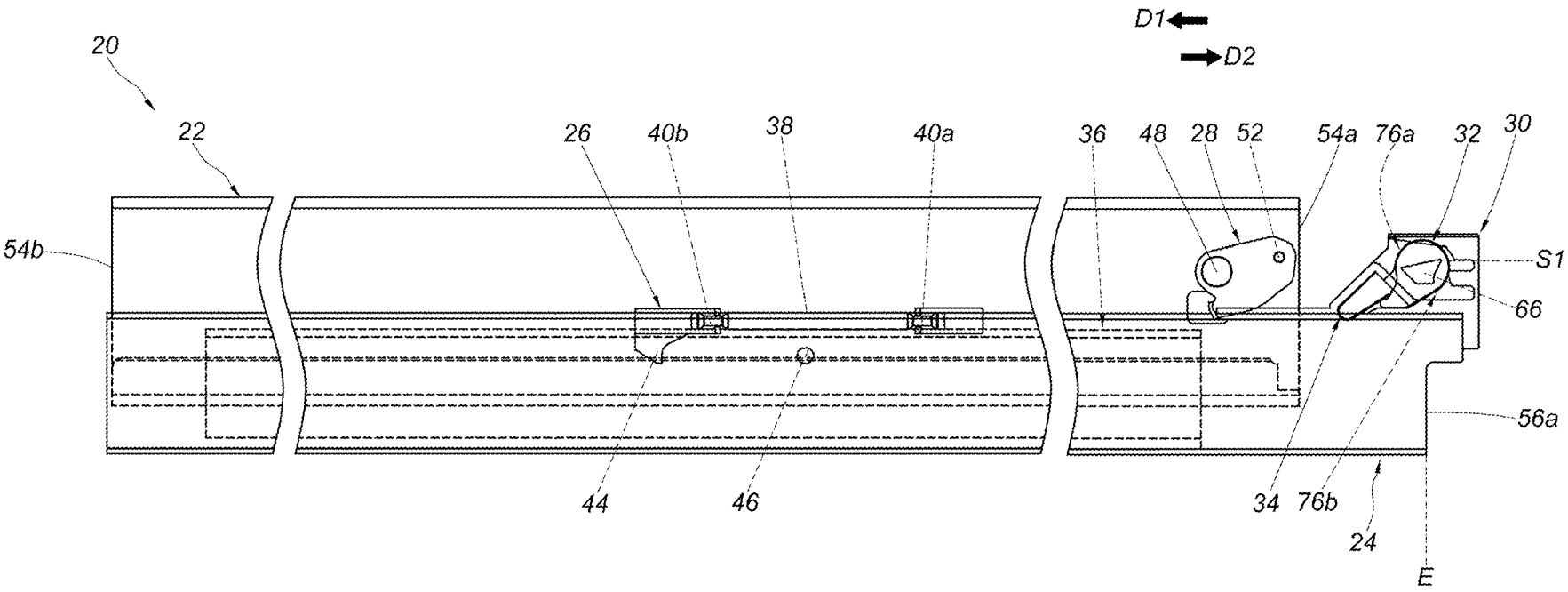
FIG. 9 is a diagram of the slide rail assembly as the second rail is located at an extended position relative to the first rail according to the embodiment of the present invention.

As shown in FIG. 7, FIG. 8 and FIG. 9, when the second rail 24 is pushed by a first force F1 from the retracted position R relative to the first rail 22 along the first direction D1, the aiding member 30 guides the controlling portion 52 of the controlling member 28 to move from the locking position L relative to the predetermined path structure 74, so as to allow the resilient member 38 to drive the second rail 24 to be opened relative to the first rail 22 along the second direction D2 by the resilient force J, e.g., until the second rail 24 is displaced to an extended position E. In other words, the slide rail assembly 20 is configured to provide a push-open mechanism which enables the second rail 24 to be opened relative to the first rail 22 along the second direction D2 by pushing the second rail 24 from the retracted position R along the first direction D1.

Preferably, as shown in FIG. 7, when the second rail 24 is pushed by the first force F1 from the retracted position R relative to the first rail 22 along the first direction D1, the controlling portion 52 of the controlling member 28 and the guiding section 78 of the aiding member 30 abut against each other, such that the controlling portion 52 of the controlling member 28 is guided to move from the locking position L into the releasing section 76*b* of the predetermined path structure 74 by the guiding section 78, so as to allow the resilient member 38 to drive the second rail 24 to be opened along the second direction D2. For example, as shown in FIG. 8 and FIG. 9, the second end 40*b* of the resilient member 38 can push the corresponding member 46 on the third rail 36 by the driving member 44 to drive the third rail 36 and the second rail 24 to be opened along the second direction D2.

Preferably, the aiding member 30 further includes a guiding feature 84. In this embodiment, by way of example, the guiding feature 84 can be an inclined surface or an arc surface. As shown in FIG. 8 and FIG. 9, during a displacement of the second rail 24 along the second direction D2 in response to the resilient force J provided by the resilient member 38, the aiding member 30 drives the controlling portion 52 of the controlling member 28 to move out of the predetermined path structure 74 to a position corresponding to the entry section 76*a* of the aiding member 30 as shown in FIG. 8 and FIG. 9 by an abutment of the guiding feature 84 and the controlling portion 52 of the controlling member 28. Therefore, during a displacement of the second rail 24 from the extended position E to the retracted position R along the first direction D1, the controlling portion 52 of the controlling member 28 can return back to the locking position L as shown in FIG. 6 by entering into the predetermined path structure 74 through the entry section 76*a*.

Figure 10:
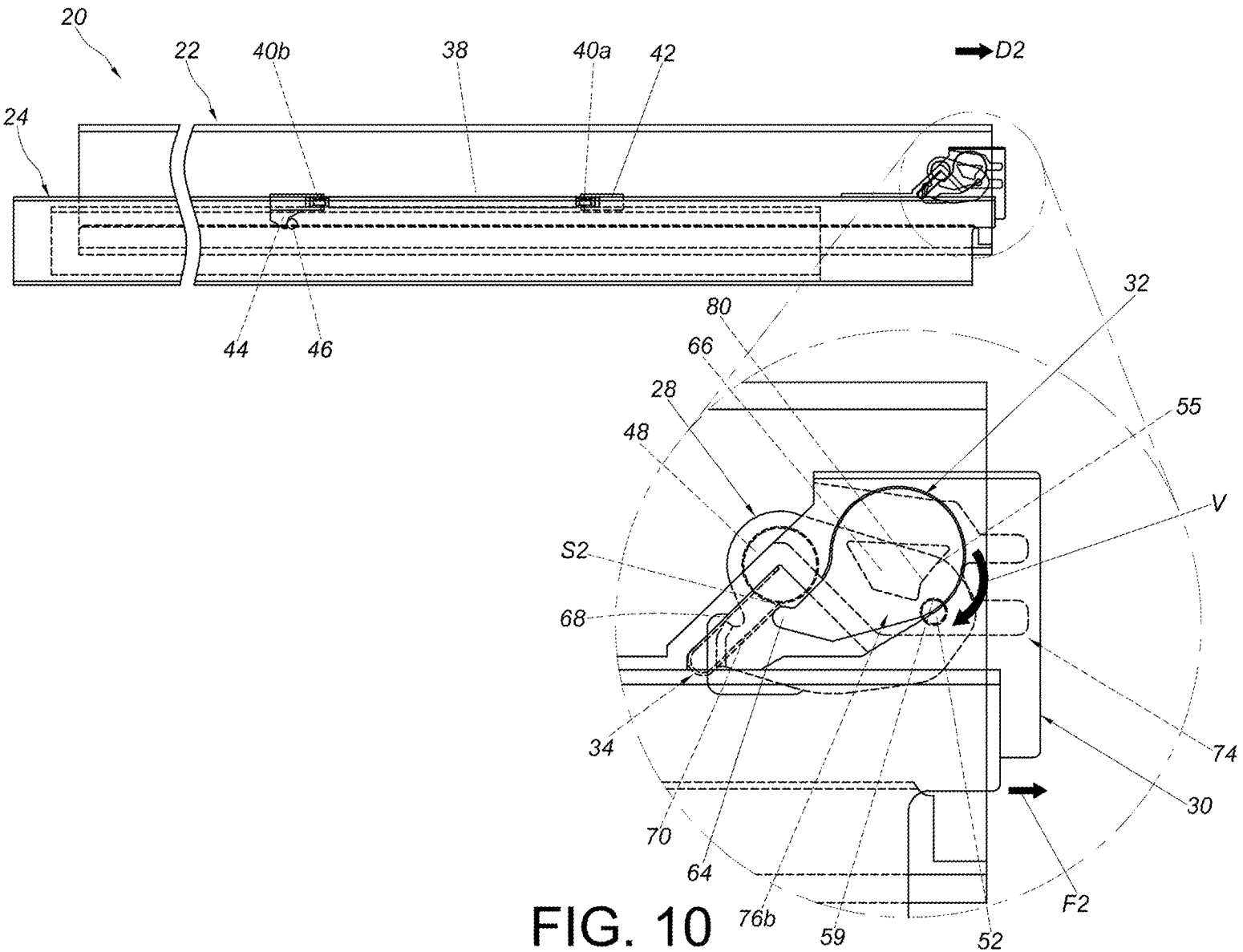
FIG. 10 is a diagram of the slide rail assembly as the second rail is pulled from the retracted position relative to the first rail along the second direction according to the embodiment of the present invention.

As shown in FIG. 6 and FIG. 10, when the second rail 24 is pulled by a second force F2 from the retracted position R relative to the first rail 22 along the second direction D2, the controlling portion 52 of the controlling member 28 and the working portion 66 of the working member 32 can abut against each other to generate an acting force V for driving the working member 32 to rotate from the first state S1 to a second state S2 as shown in FIG. 10, such that the controlling portion 52 of the controlling member 28 is moved from the locking position L relative to the predetermined path structure 74 for allowing the second rail 24 to be opened along the second direction D2.

Preferably, when the second rail 24 is pulled by the second force F2 from the retracted position R relative to the first rail 22 along the second direction D2, the controlling portion 52 of the controlling member 28 and the working portion 66 of the working member 32 can abut against each other to generate the acting force V for driving the working member 32 to rotate from the first state S1 as shown in FIG. 6 to the second state S2 as shown in FIG. 10 easily due to the offset angle A, such that the controlling portion 52 of the controlling member 28 can be driven by the working portion 66 of the working member 32 to move from the locking position L relative to the predetermined path structure 74 for allowing the second rail 24 to be opened along the second direction D2 easily. Besides, the working portion 66 of the working member 32 further includes a guiding surface 55 located adjacent to the abutting section 80. The controlling portion 52 of the controlling member 28 includes a guiding contour 59. In this embodiment, by way of example, the guiding surface 55 can be an inclined surface or an arc surface, and the guiding contour 59 can be formed in a circular shape or an arc shape. When the second rail 24 is pulled by the second force F2 from the retracted position R relative to the first rail 22 along the second direction D2, the controlling portion 52 of the controlling member 28 and the working portion 66 of the working member 32 can abut against each other to generate the acting force V by a cooperation of the guiding surface 55 and the guiding contour 59, which facilitates not only a rotating movement of the working member 32 from the first state S1 as shown in FIG. 6 to the second state S2 as shown in FIG. 10 but also a movement of the controlling portion 52 of the controlling member 28 from the locking position L into the releasing portion 76*b* of the predetermined path structure 74.

Furthermore, as shown in FIG. 10, when the working member 32 is in the second state S2, the resilient structure 34 is resiliently deformed. Therefore, once the second rail 24 is displaced from the retracted position R to a predetermined position, e.g., the extended position E, relative to the first rail 22 along the second direction D2, the working member 32 can return to the first state S1 as shown in FIG. 9 from the second state S2 as shown in FIG. 10 in response to the returning resilient force K provided by the resilient structure 34.

From the above, when the second rail 24 is located at the retracted position R relative to the first rail 22, the second rail 24 can be opened normally, i.e., by pushing the second rail 24 in the first direction D1. However, if the second rail 24 is pulled in the second direction D2 inappropriately, the rotating movement of the working member 32 relative to the aiding member 30 from the first state S1 to the second state S2, allows the controlling portion 52 of the controlling member 28 to move from the locking position L into the releasing section 76*b* of the predetermined path structure 74, which prevents abrasion or damage of the working portion 66 of the working member 32 and/or the controlling portion 52 of the controlling member 28 due to friction or a collision, so as to achieve a purpose of protection.

In summary, the slide rail assembly 20 includes the following characteristics.

1. When the second rail 24 is pulled by the second force F2 from the retracted position R relative to the first rail 22 along the second direction D2, the controlling portion 52 of the controlling member 28 and the working portion 66 of the working member 32 can abut against each other to generate the acting force V for driving the working member 32 to move from the first state S1 to the second state S2, such that the controlling portion 52 of the controlling member 28 is moved from the locking position L into the releasing section 76*b* of the predetermined path structure 74 for allowing the second rail 24 to be opened along the second direction D2. The rotating movement of the working member 32 allows the controlling portion 52 of the controlling member 28 to move from the locking position L, which prevents abrasion or damage of the working portion 66 of the working member 32 and/or the controlling portion 52 of the controlling member 28 due to friction or collision.

2. The working member 32 can return to the first state S1 as shown in FIG. 9 from the second state S2 as shown in FIG. 10 in response to the returning resilient force K provided by the resilient structure 34 once the second rail 24 is displaced from the retracted position R to the predetermined position, e.g., the extended position E.

3. When the second rail 24 is pulled by the second force F2 from the retracted position R relative to the first rail 22 along the second direction D2, the controlling portion 52 of the controlling member 28 and the working portion 66 of the working member 32 can abut against each other to generate the acting force V for driving the working member 32 to rotate from the first state S1 as shown in FIG. 6 to the second state S2 as shown in FIG. 10 easily due to the offset angle A, such that the controlling portion 52 of the controlling member 28 can be driven by the working portion 66 of the working member 32 to move from the locking position L relative to the predetermined path structure 74 for allowing the second rail 24 to be opened along the second direction D2 easily.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A slide rail assembly comprising:

a first rail;

a second rail displaceable relative to the first rail along a first direction or a second direction opposite to the first direction;

a driving device comprising a resilient member configured to provide a resilient force along the second direction;

a controlling member movably mounted on one of the first rail and the second rail, the controlling member comprising a controlling portion;

an aiding member arranged on another one of the first rail and the second rail, the aiding member comprising a predetermined path structure;

a working member movable relative to the aiding member, the working member comprising a working portion located adjacent to the predetermined path structure; and a resilient structure configured to provide a returning resilient force to the working member for resiliently retaining the working member in a first state;

wherein when the second rail is located at a retracted position relative to the first rail, the controlling member and the working portion of the working member in the first state block each other, so as to position the controlling portion of the controlling member at a locking position for maintaining the resilient force provided by the resilient member;

wherein when the second rail is pushed by a first force from the retracted position relative to the first rail along the first direction, the aiding member guides the controlling portion of the controlling member to move from the locking position relative to the predetermined path structure, so as to allow the resilient member to drive the second rail to be opened along the second direction by the resilient force;

wherein when the second rail is pulled by a second force from the retracted position relative to the first rail along the second direction, the controlling member and the working portion of the working member in the first state abut against each other to generate an acting force for driving the working member to rotate from the first state to a second state, such that the controlling portion of the controlling member is moved from the locking position relative to the predetermined path structure for allowing the second rail to be opened along the second direction;

wherein the working member returns to the first state from the second state in response to the returning resilient force provided by the resilient structure;

wherein the aiding member is configured to provide a moving space for the working member, the moving space penetrates through a first portion and a second portion of the aiding member, the working member further comprises a main body portion and an extending section, the extending section extends from the main body portion, the working portion protrudes from a surface of the main body portion, the main body portion and the extending section are located adjacent to the first portion of the aiding member, and the working portion passes through the moving space and is located adjacent to the second portion of the aiding member.

2. The slide rail assembly of claim 1, wherein the controlling member is pivotally connected to the first rail by a shaft.

3. The slide rail assembly of claim 1, further comprising a third rail movably mounted between the first rail and the second rail, and the third rail being configured to extend a displacement of the second rail relative to the first rail.

4. The slide rail assembly of claim 1, wherein the aiding member is arranged on the second rail, the predetermined path structure comprises an entry section and a releasing section communicated with the entry section, the working member is movably mounted on the aiding member, and the working portion of the working member is located between the entry section and the releasing section.

5. The slide rail assembly of claim 4, wherein the aiding member further comprises a guiding section, when the second rail is pushed by the first force from the retracted position relative to the first rail along the first direction, the controlling portion of the controlling member is guided to move from the locking position into the releasing section of the predetermined path structure by the guiding section, so as to allow the resilient member to drive the second rail to be opened along the second direction.

6. The slide rail assembly of claim 5, wherein the working portion of the working member comprises an abutting section, an offset angle is formed between an extending line passing through the abutting section and a center of the working member and an extending line passing through the center of the working member along the first direction or the second direction, and the controlling portion of the controlling member abuts against the abutting section when the controlling portion of the controlling member is located at the locking position.

7. The slide rail assembly of claim 6, wherein when the second rail is pulled by the second force from the retracted position relative to the first rail along the second direction, the controlling portion of the controlling member and the working portion of the working member in the first state abut against each other to generate the acting force for driving the working member to rotate from the first state to the second state due to the offset angle, such that the controlling portion of the controlling member is moved from the locking position into the releasing section of the predetermined path structure for allowing the second rail to be opened along the second direction.

8. A slide rail assembly comprising:

a first rail;

a second rail displaceable relative to the first rail along a first direction or a second direction opposite to the first direction;

a driving device comprising a resilient member configured to provide a resilient force along the second direction;

a controlling member movably mounted on one of the first rail and the second rail, the controlling member comprising a controlling portion;

an aiding member arranged on another one of the first rail and the second rail, the aiding member comprising a predetermined path structure, the predetermined path structure comprising an entry section and a releasing section communicated with the entry section;

a working member movable relative to the aiding member, the working member comprising a working portion located between the entry section and the releasing section, the working portion of the working member comprising an abutting section, an offset angle being formed between an extending line passing through the abutting section and a center of the working member and an extending line passing through the center of the working member along the first direction or the second direction; and a resilient structure configured to provide a returning resilient force to the working member for resiliently retaining the working member in a first state;

wherein when the second rail is located at a retracted position relative to the first rail, the controlling member and the working portion of the working member in the first state block each other, so as to position the controlling portion of the controlling member at a locking position for maintaining the resilient force provided by the resilient member by a blocking of the controlling portion of the controlling member and the abutting section;

wherein when the second rail is pulled from the retracted position relative to the first rail along the second direction, the controlling member and the working portion of the working member in the first state abut against each other to generate an acting force for driving the working member to rotate from the first state to a second state, such that the controlling portion of the controlling member is moved from the locking position relative to the predetermined path structure for allowing the second rail to be opened along the second direction;

wherein the aiding member is configured to provide a moving space for the working member, the moving space penetrates through a first portion and a second portion of the aiding member, the working member further comprises a main body portion and an extending section, the extending section extends from the main body portion, the working portion protrudes from a surface of the main body portion, the main body portion and the extending section are located adjacent to the first portion of the aiding member, and the working portion passes through the moving space and is located adjacent to the second portion of the aiding member.

9. The slide rail assembly of claim 8, wherein when the second rail is pulled from the retracted position relative to the first rail along the second direction, the controlling portion of the controlling member and the working portion of the working member in the first state abut against each other to generate the acting force for driving the working member to rotate from the first state to the second state due to the offset angle, such that the controlling portion of the controlling member is moved from the locking position into the releasing section of the predetermined path structure for allowing the second rail to be opened along the second direction.

10. The slide rail assembly of claim 8, wherein the controlling member is pivotally connected to the first rail by a shaft.

11. The slide rail assembly of claim 8, further comprising a third rail movably mounted between the first rail and the second rail, and the third rail being configured to extend a displacement of the second rail relative to the first rail.

12. The slide rail assembly of claim 8, wherein the aiding member is arranged on the second rail, and the working member is movably mounted on the aiding member.

13. The slide rail assembly of claim 8, wherein the working member returns to the first state from the second state in response to the returning resilient force provided by the resilient structure.

14. The slide rail assembly of claim 8, wherein the aiding member further comprises a guiding section, when the second rail is pushed from the retracted position relative to the first rail along the first direction, the controlling portion of the controlling member is guided to move from the locking position into the releasing section of the predetermined path structure by the guiding section, so as to allow the resilient member to drive the second rail to be opened along the second direction.

* * * * *